US006494971B1

(12) United States Patent
Kobayashi et al.

(10) Patent No.: US 6,494,971 B1
(45) Date of Patent: Dec. 17, 2002

(54) IRIDIUM-CONTAINING NICKEL-BASE SUPERALLOY

(75) Inventors: Toshiharu Kobayashi, Ibaraki (JP); Yutaka Koizumi, Ibaraki (JP); Hideyuki Murakami, Ibaraki (JP); Yoshikazu Ro, Ibaraki (JP); Yoko Yamabe, Ibaraki (JP); Shizuo Nakazawa, Ibaraki (JP); Hiroshi Harada, Ibaraki (JP); Toshihiro Yamagata, Ibaraki (JP)

(73) Assignee: National Research Institute for Metals, Ibaraki (JP)

( * ) Notice: Subject to any disclaimer, the term of this patent is extended or adjusted under 35 U.S.C. 154(b) by 0 days.

(21) Appl. No.: 09/297,041

(22) PCT Filed: Oct. 28, 1997

(86) PCT No.: PCT/JP97/03911

§ 371 (c)(1),
(2), (4) Date: Jun. 17, 1999

(87) PCT Pub. No.: WO98/18972

PCT Pub. Date: May 7, 1998

(30) Foreign Application Priority Data

Oct. 28, 1996 (JP) ..... 8-285119

(51) Int. Cl.[7] ..... C22C 19/03; C22C 1/00

(52) U.S. Cl. ..... 148/426; 148/409; 420/456; 420/590

(58) Field of Search ..... 420/456, 590; 148/426, 409

(56) References Cited

U.S. PATENT DOCUMENTS 4,261,742 A * 4/1981 Coupland et al. ..... 75/134

* cited by examiner

*Primary Examiner*—Roy King
*Assistant Examiner*—Harry D. Wilkins, III
(74) *Attorney, Agent, or Firm*—Wenderoth, Lind & Ponack, L.L.P.

(57) ABSTRACT

An iridium-containing nickel-base superalloy which has an orderly arrayed allow structure to be strengthened by precipitation and contains iridium dissolved in the γ and γ' phases to be strengthened by solid solution, thus being improved in high-temperature strength and resistance to high-temperature corrosion. The superalloy can be prepared by adding iridium to a general nickel-base superalloy

6 Claims, 4 Drawing Sheets

( a )

( b )

IRIDIUM-CONTAINING NICKEL-BASE SUPERALLOY

This application is a 371 of PCT/JP97/03911 filed Oct. 28, 1997.

TECHNICAL FIELD

The present invention relates to a heat resistant iridium-doped Ni-base superalloy. More specifically, the invention relates to a heat resistant iridium-doped Ni-base superalloy that is effective to improve output power and efficiency of a high-temperature apparatus when used as a gas turbine for power generation, a jet engine, a rocket engine and so on.

BACKGROUND ART

A heat resistant Ni-base superalloy is an alloy containing Ni as a basic constitutional element, to which main constitutional elements, such as Co, Cr, Mo, W, Al, Ti, Ta, Nb, Re, Hf and so on, are contained.

Since the heat resistant Ni-base superalloy has an excellent mechanical strength at high temperatures. For example, it is used as a turbine blade, a turbine vane and so on of a gas turbine for power generation, a jet engine and a rocket engine. In order to improve the output power and the efficiency of high temperature apparatus, it is the most effective to increase the operating temperature of the combustion gas, and improvement in high temperature properties of an heat resistant Ni-base superalloy is the exigent task to realize such increase.

The improvement in high temperature properties should be verified by two standpoints, i.e., the high temperature strength and the high temperature corrosion resistance.

In order to improve the high temperature strength of the heat resistant Ni-base superalloy, the addition of W, Mo, Ta, Re and so on, for example, has been attempted. However, it has been confirmed that the excessive addition of these elements promotes the precipitation of a harmful phase, because it deteriorates the microstructural stability of the alloy, and accordingly the strength of the Ni-base superalloy is lowered as contrary to the intention.

The improvement in high temperature corrosion resistance is another important problem since the material is used in a highly corrosive atmosphere. For example, turbine blade of a gas turbine are exposed in a severely oxidative gas atmosphere due to combustion. Furthermore, since a fuel contains sulfur and a thermal electric power plant is generally located near a coast, the blades are also exposed in a corrosive atmosphere due to the combustion gas including a large amount of salt.

In order to improve high temperature corrosion resistance of the blades that are used under such a severe oxidative and corrosive atmosphere, it is dangerous to depend only on a coating having good corrosion resistance unless it is guaranteed that the coating layer is not broken. To improve the high temperature corrosion resistance of the Ni-base-superalloy itself is the more reliable solution.

The objective of the invention is to provide a heat resistant Ni-base superalloy that has excellent high temperature strength and high temperature corrosion resistance.

DISCLOSURE OF THE INVENTION

The invention provides a heat resistant Ni-base superalloy that has excellent high temperature strength and high temperature corrosion resistance by adding iridium having a high melting point.

When iridium (Ir) is added, the alloy structure is arrayed to maintain structural stability well, and the precipitation strengthening enchanced. At the same time, iridium dissolved in the γ phase and the γ' phase to proceed solid solution strengthening. Iridium has the race-centered cubic structure, which is the same as Ni, and therefore easily substitutes for Ni. W, Mo, Ta and the like, which have been used as the alloying elements, have the body-centered cubic structure, and Re and the like have the close-packed hexagonal structure, which is considered to be one of the reasons of lowering the structural stability.

Accordingly, the iridium-added heat resistant Ni-base superalloy has an excellent high temperature strength, and can withstand the use under a high temperature and a high stress.

Furthermore, iridium has a high melting point and exhibits a small diffusion coefficient at a high temperature. Therefore, the deterioration of the characteristics of the heat resistant Ni-base superalloy is thus suppressed, and the high temperature corrosion resistance is improved.

The amount of iridium added is necessarily at least 0.1 atomic % to sufficiently exhibit the improvement in high temperature strength and high temperature corrosion resistance. On the other hand, the upper limit is not particularly strict, and can be appropriately adjusted depending on the use of the Ni-base superalloy. In general, when the amount exceeds 5 atomic %, the specific density is increased, and it affects the price. Therefore, with respect to the amount of iridium, between 0.1 atomic % and 5 atomic % can be preferably exemplified.

As the heat resistant Ni-base superalloy itself, various kinds thereof can be employed. For example, TMS-63 (6.9Cr-7.5Mo-5.8Al-8.4Ta-balance Ni (weight %)) as one or an Ni-base single crystal alloy, Mar-M247 (10Co-10W-8.5Cr-0.7Mo-5.5Al-3Ta-1.4Hf-0.16C-0.02B-0.1Zr-balance Ni (weight %)) as one of Ni-base polycrystalline alloys, and the like are exemplified.

BEST MODE FOR CARRYING OUT THE INVENTION

The iridium-doped heat resistant Ni-base superalloy of the invention will be described with showing the examples below.

EXAMPLE 1

To a heat resistant Ni-base superalloy TMS-63 (6.9Cr-7.5Mo-5.8Al-8.4Ta-balance Ni (weight %)), 1 atomic % or 2 atomic % of iridium was added by an arc melting method.

The iridium-added Ni-base superalloys and TMS-63 added without iridium were subjected to a compressive test at 1,100° C. in the air.

Figure 1:
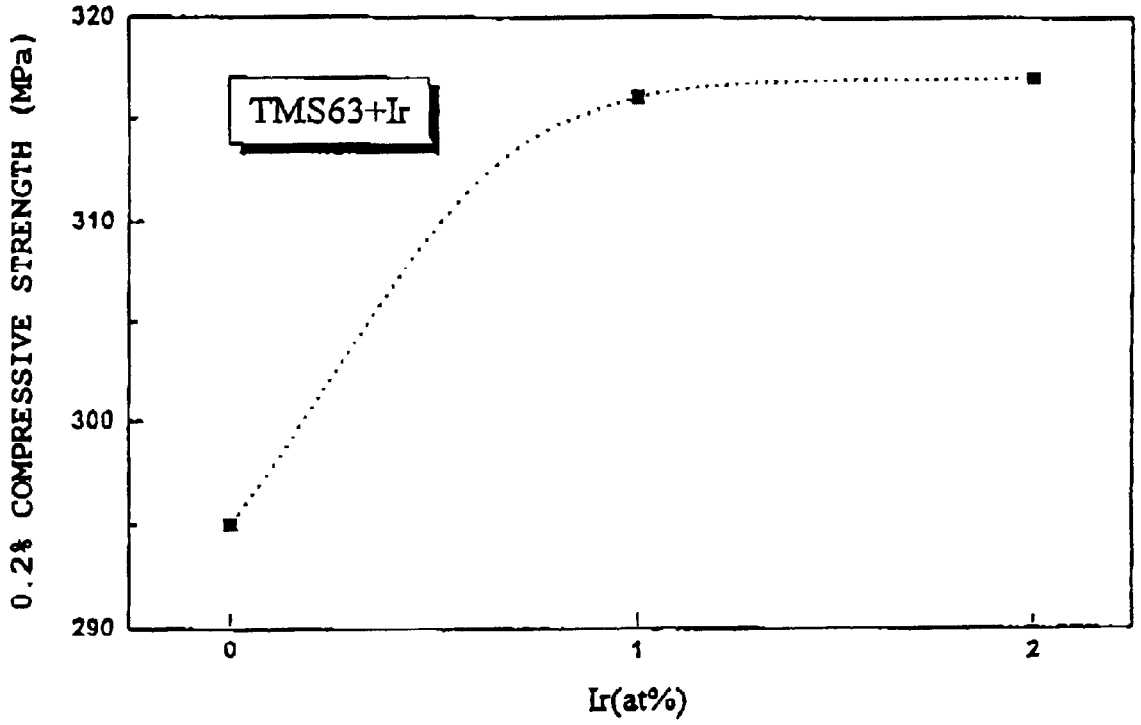
FIG. 1 shows the 0.2% compressive strength of the heat resistant Ni-base superalloy as a function of amount of iridium added.

On the 0.2% compression test, as shown in FIG. 1, the iridium-doped Ni-base superalloys exhibited strength of 316 MPa (1 atomic % added) and 317 MPa (2 atomic % added), which were larger than 315 MPa. On the other hand, TMS-63 only exhibited 295 MPa. It has been confirmed that the iridium-doped heat resistant Ni-base superalloy has a strength at high temperature in comparison to conventional higher TMS-63.

Figure 2:
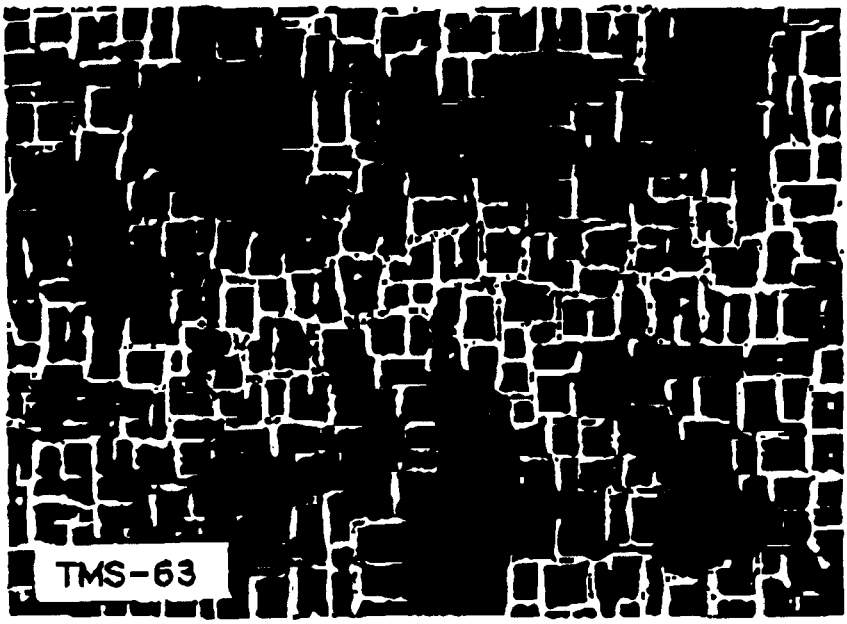
FIG. 2(*a*) and (*b*) are micrographs showing the alloy structures of (a) TMS-63 and the (b) iridium-doped TMS-63 in which 2 atomic % of iridium is added.
Figure 2:
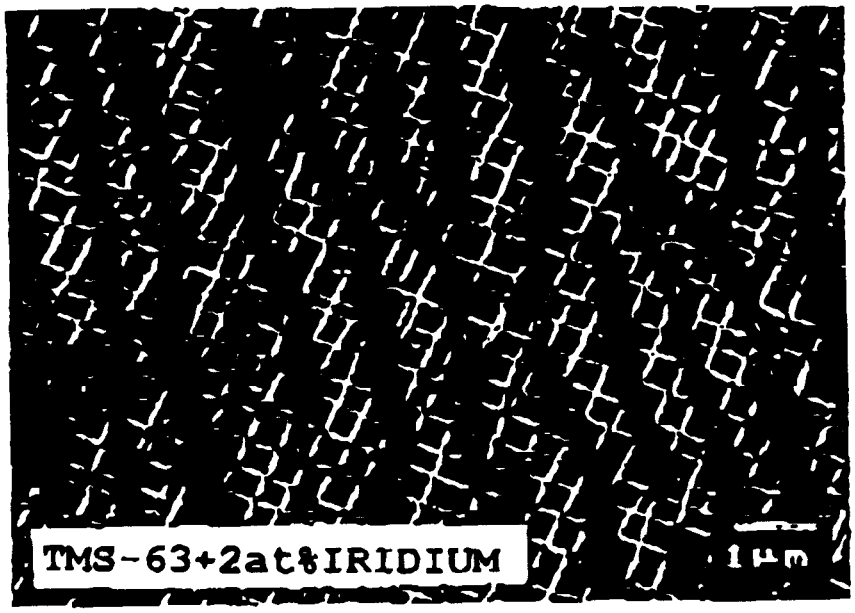

Furthermore, as shown in FIGS. 2(*a*) and (*b*), it has been confirmed that in the iridium-doped Ni-base superalloy, the alloy structure is orderly arrayed. The precipitation strengthening proceeds by the arrayed alloy structure. In the micrographs of FIGS. 2(*a*) and (*b*), the background is the phase and the γ' phase is observed as a black cubic form.

The added iridium is dissolved in the γ phase and the γ' phase and plays a role as a solid solution strengthener. In the addition of 2 atomic %, iridium is dissolved in the γ phase and the γ' phase to a concentration ratio of 2:1 at 870° C.

Despite such an addition of iridium, no harmful phase is precipitated in the alloy.

While temperature capability of the Ni-base superalloy is around 1,100° C., the mechanical properties at this temperature range of the iridium-doped Ni-base superalloy have been improved by the addition of iridium, with excellent structural stability.

EXAMPLE 2

1.5 atomic % of iridium was added to the above-described heat resistant Ni-base superalloy TMS-63 by a vacuum melting method, to produce a single crystal alloy. The composition of the iridium-doped Ni-base superalloy is expressed by 6.5Cr-7.1Mo-5.5Al-7.9Ta-5.7Ir-balance Ni (weight %).

The high temperature strength was evaluated by the creep test. The test conditions were in the air at 900° C. and 40 kgf/mm$^2$. The FIG. 3 shows the results.

Figure 3:
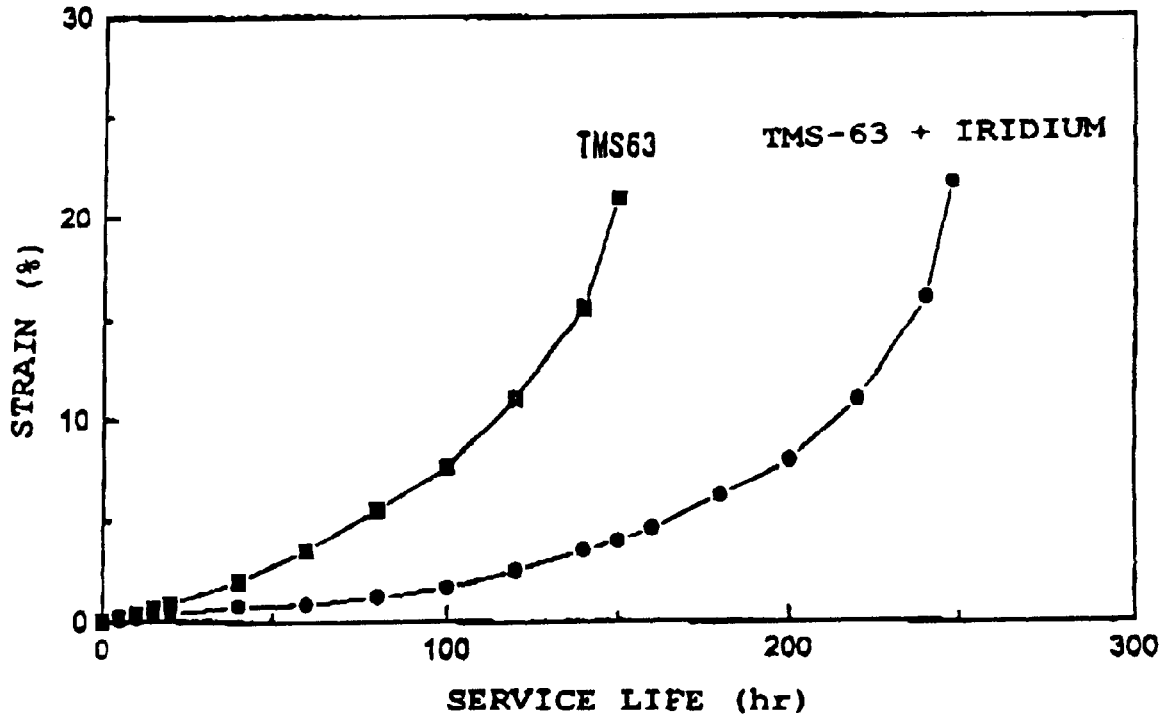
FIG. 3 shows a service life (time)-strain (%) curve obtained by the creep test of TMS-63 and the iridium-doped TMS-63 in which 1.5 atomic % of iridium is added.

It is clear from FIG. 3 that while the service life of TMS-3 was 150 hours that of the iridium-doped TMS-63 by adding 1.5 atomic % of iridium was 250 hours, which confirms the improvement of creep life.

Furthermore, the high temperature corrosion resistance was evaluated.

In a crucible, and A sample with 6 mm in diameter and 4.5 mm in length was immersed into a crucible in which a mixed salt of 12 g containing 25% of NaCl and 75% of $Na_2SO_4$.

Figure 4:
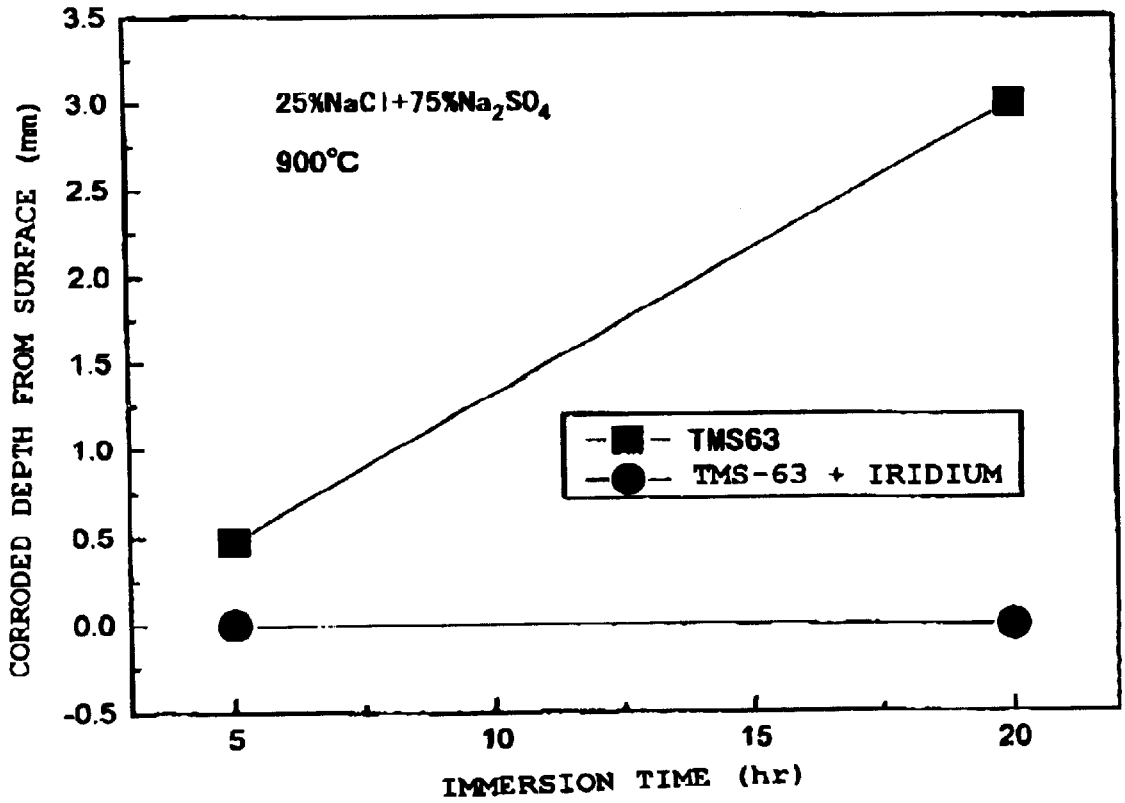
FIG. 4 shows the relationship between the immersion time and the corroded depth from the surface of TMS-63 and iridium-doped TMS-63.

The test temperature was 900° C. and the test time was from 5 to 20 hours. The relationship between the immersion time and the corroded depth from the surface of TMS-63 and iridium-doped TMS-63 was shown in FIG. 4.

In the Ni-base super heat Ni-base, only oxidation without corrosion was observed of such that a thin oxide film was slightly formed on the surface even by the immersion for 20 hours. On the other hand, in TMS-63, corrosion proceeded toward the core by immersion for such a short period of 5 hours. Such corrosion was also observed in Mar-M247, similar corrosion to TMS-63 was observed.

The iridium-doped heat resistant Ni-base superalloy also has improved high temperature corrosion resistance. It has been confirmed that the iridium-doped Ni-base superalloy is an extremely useful heat resistant alloy on practical use.

INDUSTRIAL APPLICABILITY

As described in detail in the foregoing, according to the invention, an iridium-doped heat resistant Ni-base superalloy is developed. This alloy has the stable alloy structure, improved high temperature strength and high temperature corrosion resistance, and is extremely useful on practical use. The iridium-doped heat resistant Ni-base superalloy can be applied to a component exposed under a high temperature and a high stress in a high temperature apparatus. For example, by applying this material to a turbine blade, a turbine vane and the like of a gas turbine for power generation, as well as a jet engine, a rocket engine and the like, the output power and efficiency of the high temperature apparatus will be improved.

What is claimed is:

1. An iridium-doped heat resistant Ni-base superalloy comprising a heat resistant Ni-base superalloy doped with iridium in a range from 1 to 2 atomic %, said superalloy having an orderly arrayed alloy structure in which iridium is dissolved in γ and γ' phases, both of which are strengthened by iridium solid solution, and said superalloy being strengthened by said orderly arrayed alloy structure and exhibiting higher strength at 1,100° C. than any other heat resistant Ni-base superalloy that is not doped with iridium.

2. An article comprising the iridium-doped heat resistant Ni-base superalloy as claimed in claim 1.

3. A method of making the iridium-doped heat resistant Ni-base superalloy as claimed in claim 1, which comprises adding 1 to 2 atomic % of iridium to a heat resistant Ni-base superalloy.

4. The iridium-doped heat resistant Ni-base superalloy as claimed in claim 1, wherein the Ni-base superalloy is TMS-63.

5. An article comprising the iridium-doped heat resistant Ni-base superalloy as claimed in claim 1.

6. A method of making the iridium-doped heat resistant Ni-base superalloy as claimed in claim 4, which comprises adding 1 to 2 atomic % of iridium to a heat resistant Ni-base superalloy.

* * * * *